United States Patent [19]

Fisher

[11] 4,002,123

[45] Jan. 11, 1977

[54] DUAL CHANNEL REDUNDANT FUZE

[75] Inventor: Evan D. Fisher, Chevy Chase, Md.

[73] Assignee: The United States of America as represented by the Secretary of the Army, Washington, D.C.

[22] Filed: July 11, 1975

[21] Appl. No.: 595,189

[52] U.S. Cl. ..... 102/70.2 G; 102/81

[51] Int. Cl.[2] ..... F42C 11/04

[58] Field of Search ..... 102/70.2 R, 70.2 G, 102/81, 70 B

[56] References Cited

UNITED STATES PATENTS

| | | | |
|---|---|---|---|
| 2,468,120 | 4/1949 | Senn | 102/70.2 G |
| 3,332,642 | 7/1967 | Halling | 102/70.2 R |
| 3,757,695 | 9/1973 | Fisher | 102/70.2 G |
| 3,804,020 | 4/1974 | Norton | 102/70.2 R |

*Primary Examiner*—Verlin R. Pendegrass
*Attorney, Agent, or Firm*—Nathan Edelberg; Robert P. Gibson; Saul Elbaum

[57] ABSTRACT

A redundant two-channel electromechanical fuze. The fuze contains two air-driven turbines which, in turn, drive independent electrical alternators, the shafts of which drive governors that regulate constant speed gear-reducing assemblies. The latter assemblies rotate independent detonator-containing rotors from a safe in-line position to a fully armed position. The output from the electrical alternators are fed to electronic timing circuits via a novel barometric sensing switch element. The barometric element includes a pressure sensitive diaphragm for closing a pair of contacts to connect the alternator output to the timing circuit only after the fuzed projectile has experienced a predetermined minimum free fall distance. The barometric sensing switch element housing further comprises a second diaphragm which, when activated by ram air, serves to unlock the turbine wheels for rotation, while simultaneously establishing a reference pressure for the first diaphragm. The fuze circuits include redundant impact/shock switches as well as delay functions which are cross-coupled to one another to ensure high reliability.

18 Claims, 4 Drawing Figures

DUAL CHANNEL REDUNDANT FUZE

RIGHTS OF THE GOVERNMENT

The invention described herein may be manufactured, used, and/or licensed by or for the United States Government for governmental purposes without the payment to me of any royalty thereon.

BACKGROUND OF THE INVENTION

1. Field of the Invention

This invention is related to fuzing devices and, more particularly, is directed towards a redundant dual channel electro-mechanical fuze utilized preferably in conjunction with aircraft-carried bombs.

2. Description of the Prior Art

Fuzing systems presently utilized for aircraft-carried bombs unfortunately employ relatively outdated and sometimes unreliable point detonation mechanical fuzes. While being relatively inexpensive, such fuzes suffer from certain defects, among which is a propensity to malfunction upon encountering trees or other foliage prior to reaching an optimum detonation point. Furthermore, the safety and arming systems associated with such bomb fuzes are not as safe or reliable as they should be, and in fact do not comply with present-day military requirements which call for the provision of two positive environmental signatures prior to arming.

Proposals have been made to modernize certain fuzes for aircraft-carried bombs by, for example, utilizing slipstream actuated charging systems which employ environmental ram air to generate electrical energy within the bomb itself, thereby dispensing with the special electric charging gear formerly required on board the aircraft. Such an approach is exemplified by my prior U.S. Pat. No. 3,757,695. While generally satisfactory, the approach therein described suffered from a major deficiency in failing to provide the requisite two environmental signatures prior to arming. Other deficiencies, such as premature arming of the fuze due to accidental exposure of the device to slipstream ram air have also been recognized.

Accordingly, there exists today a great need for an inexpensive electro-mechanical point detonation fuze that provides high reliability without sacrificing safety features required by present-day military specifications. More particularly, the need exists to provide a highly reliable, redundant, two-channel fuze particularly adapted for use with aircraft-carried bombs, which incorporates means for providing the two positive environmental signatures prior to arming thereof.

Prior art patents directed to differential barometric pressure sensing elements of which I am aware include: U.S. Pat. Nos. 2,330,873; 2,940,392; 3,780,659; and 3,804,020. Each of the foregoing patents, while individually useful, nevertheless fall far short of providing the combination of reliability and safety according to the present invention to be described in more detail hereinafter.

OBJECTS AND SUMMARY OF THE INVENTION

It is therefore a primary object of the present invention to provide a dual channel redundant fuze for aircraft-carried bombs which overcomes all of the disadvantages noted hereinabove with respect to the prior art devices.

A further object of the present invention is to provide a dual channel redundant fuze for aircraft-carried bombs which is inexpensive, easily adaptable to existing bombs, is highly reliable, and provides modular versatility with respect to a proximity function.

Another object of the present invention is to provide a dual channel redundant fuze for aircraft-carried bombs which complies with present-day military requirements by requiring two positive environmental signatures prior to the arming thereof.

A still further object of the present invention is to provide a dual channel redundant fuze for aircraft-carried bombs which incorporates a unique barometric sensing switch element that senses the two environmental signatures and actuates mechanical and electrical circuitry in response thereto.

The foregoing and other objects are attained in accordance with one aspect of the present invention through the provision of a dual channel redundant fuze for aircraft-carried bombs which comprises a fuze housing that contains a pair of substantially identical actuation channels. Each of the actuation channels includes a ram-air actuated turbine-alternator assembly for generating electricity. The shaft of the alternator is coupled through a governor to a gearbox, the output of which rotates a rotor containing a detonator from a safe position to an armed position. Each channel includes a booster which is explosively responsive to the actuation of the detonator, the latter occurring, as is well known, only when in the armed position. The fuze further includes an air valve safety device positioned along a midline longitudinal section of the bomb for transferring slipstream ram air to the fuze housing to drive the turbine wheels. The output from the turbine-driven alternators are fed to electronic circuit timing means. Electrically interposed between the alternator output and the electronic circuitry are a pair of contacts which are physically connected to a barometric sensing switch means which takes the preferred form of a pressure-sensitive diaphragm and chamber assembly.

The barometric sensing switch element includes a pair of flexible diaphragms which, together with a rigid middle wall, define four chambers. One of the diaphragms has a turbine lock assembly associated therewith and is activated upon the receipt of ram air for unlocking the turbine wheels and for closing one of the chambers associated with the second diaphragm in order to establish a reference pressure therein. The other chamber associated with the second diaphragm is sensitive to ambient pressure to activate the diaphragm when a predetermined minimum altitude is reached to close the electrical contacts and thereby establish electrical communication between the output of the alternator and the electronic timing circuitry. Each of the dual channels include cross-coupled circuitry to ensure high reliability.

BRIEF DESCRIPTION OF THE DRAWINGS

The foregoing and other objects, aspects, uses, and advantages of the present invention will become more fully appreciated as the same becomes better understood when considered in connection with the following detailed description of the present invention viewed in conjunction with the accompanying drawings, in which.

DETAILED DESCRIPTION OF THE PREFERRED EMBODIMENTS

Figure 1:
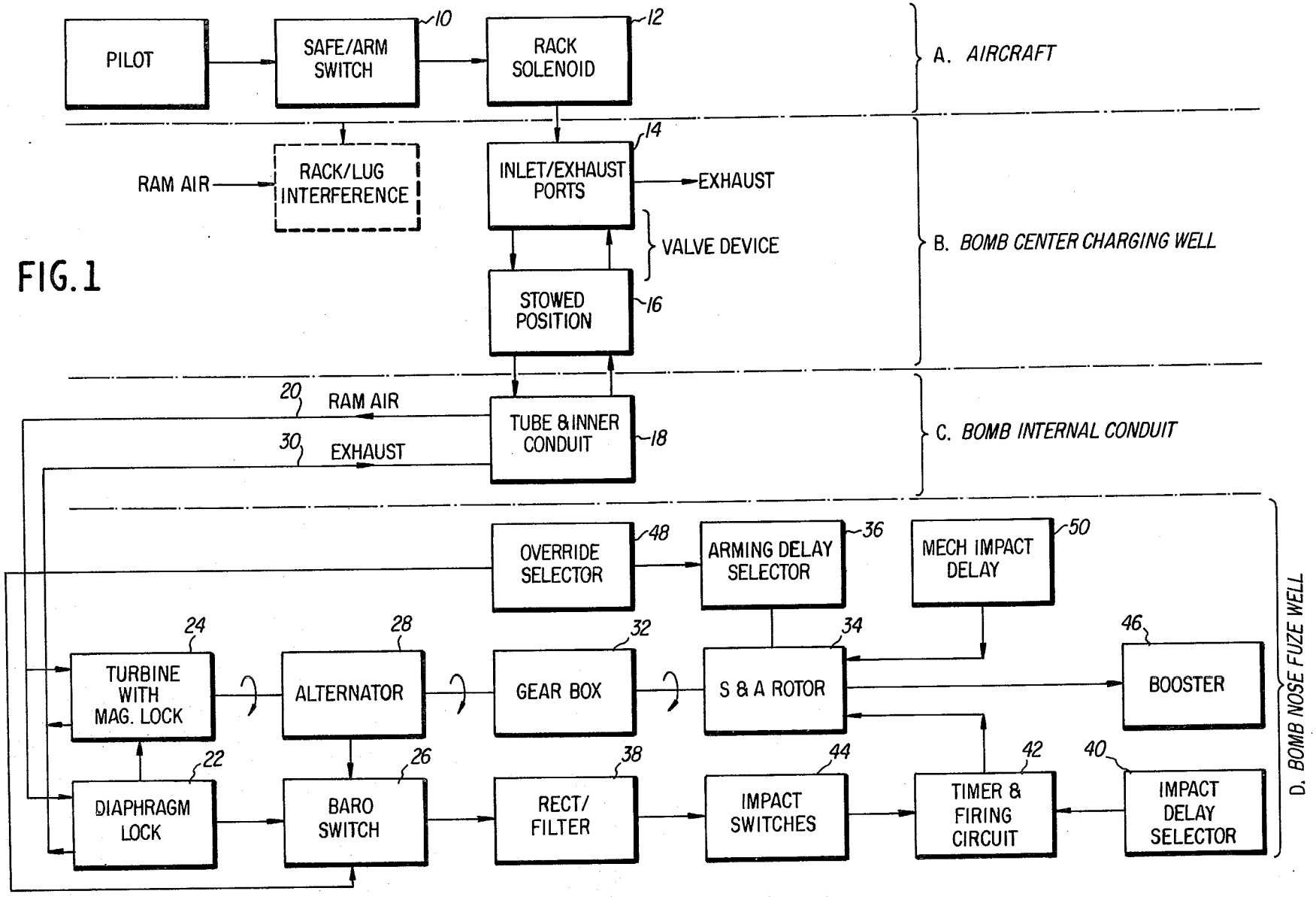
FIG. 1 is a block diagram of the dual channel, high performance redundant fuze system according to a preferred embodiment of the present invention.

A common, high explosive, general purpose bomb generally includes a centrally located receptacle or charging well positioned along the longitudinal periphery thereof. The general configuration is as illustrated in FIG. 1 of my prior U.S. Pat. No. 3,757,695. The bomb is suspended by means of a pair of latches from a standard bomb rack, the latches engaging lugs formed integrally with the bomb. The dual-channel redundant fuze, to be described in more detail hereinbelow, is preferably mounted behind a removable noseplug which preferably comprises a 5-inch diameter steel nosepiece. Ram air is directed to the fuze in the nose of the bomb by means of a novel air valve safety device positioned within the charging well. As described in much greater detail in my co-pending application Ser. No. 554,339, filed Feb. 28, 1975, now U.S. Pat. No. 3,960,086, the specification of which is expressly incorporated herein by reference, the charging well device comprises a spring-actuated air valve, which when released, extends from the charging well of the bomb such that an inlet port is placed in the slipstream of air flowing thereby. The slipstream is directed via a flexible conduit to the air-actuated fuze located in the nose of the bomb. An exhaust tube encircles the inlet tube so as to direct the exhaust air back through the valve outlet port. The unique air valve design incorporates several features which provide greater safety and reliability than heretofore experienced in similar devices. More particularly, the air valve utilizes a heavy actuating spring which ensures that it will be extended to its maximum height to place the ram air inlet port in an unobstructed position regardless of the nature of the suspension lugs utilized on the bomb. The air valve device effectively copes with accidental release, further requiring a dynamic air supply for which the valve device must be extended to its maximum height in order to uncover the exhaust port. Further advantages, explained in more detail in my co-pending application, accrue from the internal concentric tube air conduit configuration.

Referring now to FIG. 1, a block diagram of the total weapon system is depicted which includes, for the sake of detail, the pilot/aircraft interface. In order to simplify the following description of the operational sequence of the fuze system, only one out of the two channels of the dual channel system is depicted in FIG. 1 and will be described hereinafter. It should, of course, be fully understood from a consideration of FIG. 2 that the preferred embodiment fuze system contains two substantially identical channels which include cross-coupling in order to achieve the desired high reliability.

For illustrative purposes, and for ease of explanation, assume the mission profile requires the bombs to be released at an altitude of, for example, 5,000 feet, and that the velocity of the aircraft is greater than 250 knots. Also assume that each of the fuzes are set to provide a 8-second arming time. Referring again to FIG. 1, the pilot, after becoming air-borne, activates the arming switch 10 from "safe" to "arm" and releases the bombs. As the bombs separate from the aircraft, a short bungee cord, attached to the charging well cover and arming solenoid 12, is stretched. As explained more fully in the above-cited co-pending application, when the cord sustains a tension of from approximately 40 to 70 pounds, a pop-up cover is released to thereby expose the air valve device in the center charging well of the bomb. A heavy spring ensures that the valve will be extended from its stowed position 16 to its maximum height in order to place the ram air inlet and exhaust port 14 in an unobstructed position. Slipstream ram air flowing along the longitudinal surface of the bomb is then directed into plastic tubing 18 which extends from the center charging well through an internal path to the bomb nose fuze well and the fuze housing positioned therein. The ram air is directed to the nose via conduit 20, the exhaust air being directed back out through the same air valve charging device via exhaust conduit 30.

The ram air supplied to the fuze via conduit 20 performs two basic functions. Firstly, a diaphragm lock device 22 is activated to unlock a positive bias spring plunger on the turbine wheel 24 which thereby enables the turbine wheel to freely rotate in response to the ram air. The wind-driven turbine 24 also has an inherent magnetic lock which prevents rotation thereof until a minimum air velocity threshold is released. The output of the turbine drives an alternator 28 having a shaft which, in turn, drives a governor that regulates a constant speed gear reducing assembly 32. Gear assembly 32 rotates a rotor 34 which contains a detonator from a safe in-line position to a fully armed position where detonation of the booster 46 is possible.

The second basic function performed by the ram air supplied via conduit 20 is to close a valve in a barometric sensing switch assembly 26 to establish a reference of atmospheric pressure at the altitude of release. After the bomb has fallen, for example, approximately 1,000 feet, the barometric sensing switch element 26 closes due to the differential pressure (approximately 1 inch of mercury). The closure of switch 26 connects the electrical output of the alternator 28 to the remainder of the fuze circuitry which includes a rectifier/filter circuit 38, impact switches 44, and a timer and firing circuit 42, all of which are individually well known in the art.

During the initial free fall, as stated above, the rotating turbine 24 progressively arms the fuze mechanically via gear box 32. The bomb is fully armed when the detonator contained within rotor 34 is rotated to an in-line position over the explosive output leads. Various selectable arming times may be obtained by adjusting the angle of rotor 34 and said leads by means of arming selector 36. Upon completion of the arming cycle, a function will occur upon impact either by a shock-sensitive switch or by an inertial switch, or by means of an independent delay stab detonator which provides a redundant back-up function.

Delayed functioning after impact may also be selected at the time of the loading of the bomb by means of an impact delay selector 40. For example, delay times up to 0.25 seconds, in increments of 0.05 seconds, may be electrically provided by means of redundant digital solid state timers, included within circuitry 42. As indicated above, an independent mechanical striker-stab detonator system 50 is included as a back-up feature to provide a 5 to 10 second delay. The system set forth above provides a fuze reliability of 0.998 at a 90 percent confidence level.

Figure 2:
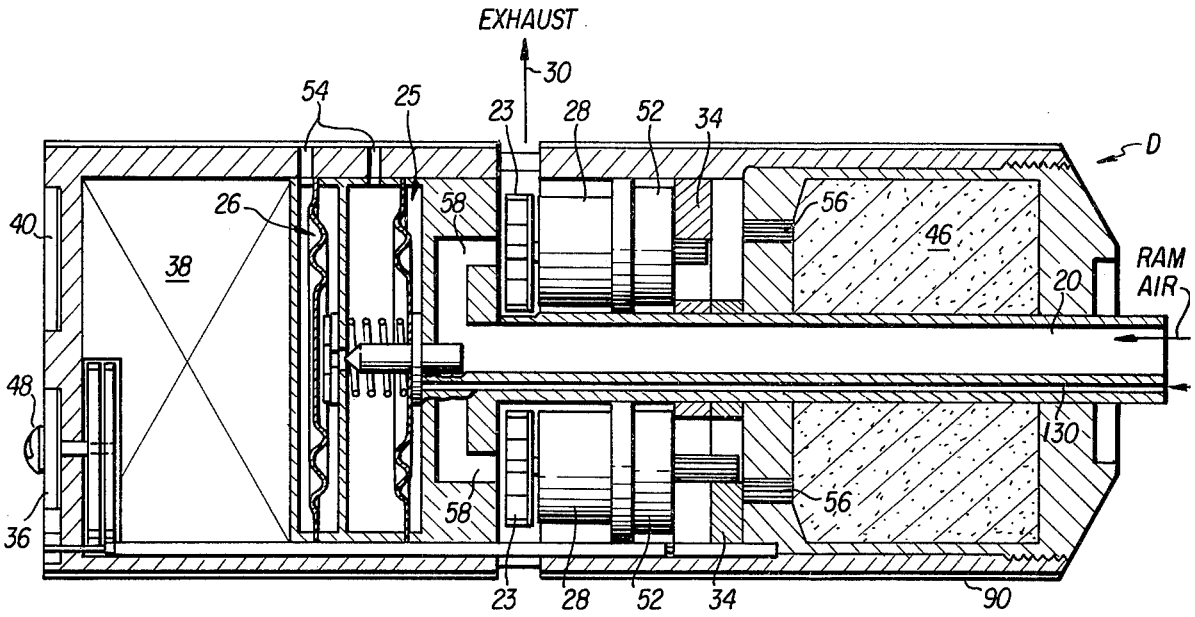
FIG. 2 is a side sectional view of a preferred embodiment of the fuze housing assembly in accordance with the present invention.

Referring now to FIG. 2, a cross-sectional view of a preferred embodiment of the dual-channel redundant fuze according to the present invention is illustrated and is seen to consist of a pair of substantially identical channels, each of which includes a turbine 23, an alternator 28, a governor control 52, a safety and arming rotor 34, explosive leads 56, and booster 46, all elements operative as set forth hereinabove. Ram air is admitted via inlet conduit 20 through side conduit 58 in order to rotate turbines 23. The turbine lock assembly is indicated generally in FIG. 2 at 25, while the pressure sensitive portion of the barometric sensing switch element is indicated generally at 26. A pair of vents 54 to ambient are illustrated in communication with a pair of the chambers formed within elements 25 and 26, while the electronics 38 of the fuze are physically positioned aft of the elements 25 and 26. The arming delay selector 36 is illustrated for selecting arming delays from four to 20 seconds, for example, as is the impact delay selector 40. An override selector 48 is also illustrated.

Figure 3:
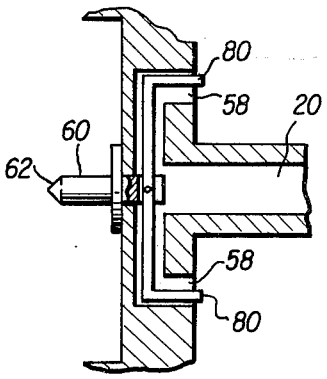
FIG. 3 is a sectional view of the detail of the turbine safety lock apparatus in accordance with the present invention.
Figure 4:
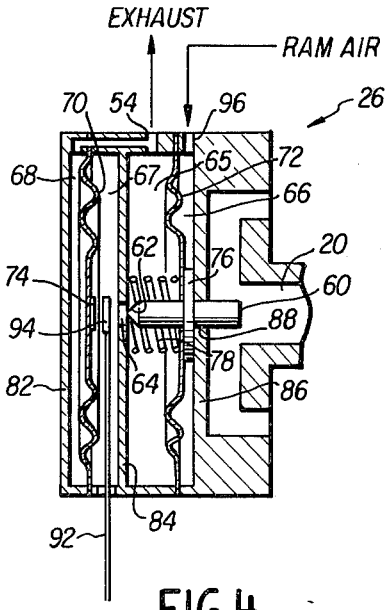
FIG. 4 is a cross-sectional view of a preferred embodiment of the barometric sensing switch element in accordance with the present invention.

Referring now to FIG. 3, the turbine lock assembly of FIG. 2 is illustrated in more detail and is seen to comprise an inlet conduit 20 for receiving ram air and delivering same via side conduits 58 to the turbine wheel. Positioned substantially concentrically within inlet conduit 20 is a turbine lock shaft 60 having a rigid lock arm 80 connected thereto. Turbine lock shaft 60 further has formed at one end thereof a valve 62, the purpose of which will become more clear hereinafter. Turbine lock shaft 60, as best seen in FIG. 4, is also connected to be laterally movable with a diaphragm 72 that is actuated by ram air so as to move turbine lock shaft 60 to the left as viewed in FIG. 3. The foregoing movement "unlocks" lock arm 80 from turbine 23 so as to enable the latter to freely rotate in response to the ram air received from conduits 58.

Referring now to FIG. 4, the barometric sensing switch element is indicated generally by the reference numeral 26 and is seen to include the turbine lock shaft 60 and valve 62 described above in connection with the turbine lock assembly. Valve 62 is adapted to be fitted within a vent 64 in a rigid center wall 84 of the switch 26. Front wall 86 includes an aperture 88 centrally formed therein for receiving turbine lock shaft 60 and allowing same to be slideably reciprocated therein. Vent 64 provides a fluid communication path between a pair of chambers 65 and 67.

A pair of flexible diaphragms 70 and 72 respectively separate chambers 67 and 65 from adjacent chambers 68 and 66, respectively. Chamber 66 is in communication with a ram air inlet channel 96, shown in FIG. 4 along the side of the barometric switch 26 for the sake of illustration, although it is understood that it is in communication with the ram air inlet 20 of FIG. 2. Similarly, chamber 68 is in communication with the ambient exhaust, as is chamber 65, via an outlet conduit 54, also schematically illustrated, it being understood that channel 54 is in fluid communication with exhaust channel 30 of FIG. 2.

Turbine lock shaft 60 is rigidly connected to diaphragm 72 and is adapted to be movable laterally therewith. A spring 78 is disposed between rigid center wall 84 and diaphragm 72 so as to bias the latter, along with lock shaft 60, to the right as seen in FIG. 4. A limit plate 76 is attached to lock shaft 60 so as to limit the biased movement of shaft 60.

A pair of electrical contacts 74 and 94 are disposed within chamber 67, contact 74 being connected physically to the midpoint of diaphragm 70 as shown. A pair of output leads (not shown) extend from contact 74 to the electronic circuitry 38, while a pair of leads 92 extend from contact 94 to the output from the alternators 28. Closure of the contacts 74 and 94, therefore, establishes electrical communication between the outputs of alternators 28 and electronic circuitry 38.

The operation of the device depicted in FIG. 4 will now be described. Initially, prior to the admission of ram air to port 96, the condition of the device is essentially as illustrated in FIG. 4, chambers 65 and 68 both at ambient pressure via conduit 54. Chamber 67 is also at ambient pressure, being in open fluid communication with chamber 65 via vent 64.

As ram air is introduced through conduit 96 into chamber 66, diaphragm 72 begins to move to the left, as viewed in FIG. 4, in opposition to the bias force produced by spring 78. As diaphragm 72 moves to the left, turbine lock shaft 60 moves therewith, to thereby unlock the pair of turbines 23 by means of the disengagement of turbine lock arm 80, as explained above in conjunction with FIG. 3. When ram air has fully moved diaphragm 72 to its full leftmost position, valve 62 closes vent 64 so as to establish a "reference" ambient pressure in now-closed chamber 67. At this point, turbines 23 are freely rotating to bring the detonators of S & A rotors 34 into alignment with the explosive output leads.

As the bomb drops further from the aircraft, the change in pressure is "sensed" by a concomitant change in pressure in chamber 68 by virtue of its fluid communication with the ambient via outlet 54. The pressure will therefore increase in chamber 68 as the bomb drops to move diaphragm 70 to the right as viewed in FIG. 4. Eventually, upon obtaining a predetermined drop, diaphragm 70 will have moved to the point where contacts 74 and 94 contact one another so as to establish an electrical path for the output of the turbine alternators 28 to the electronics 38 and thereby fully arm the fuze.

In accordance with a preferred embodiment of the element 26 depicted in FIG. 4, diaphragms 70 and 72 are each approximately 2.5 inches in diameter with a total area of approximately 5 inches. Thus, at a release velocity of 250 knots, a differential pressure of 1.5 psi will be developed between the intake and exhaust ports 96 and 54, respectively. The 1.5 psi pressure will produce a force of 7.5 pounds on diaphragm 72 which is sufficient to overcome the positive bias spring 78 to unlock the turbine lock shaft 60. An altitude change of, for example, 1,000 feet represents a change of 1 inch of mercury, or an equivalent change of 0.5 psi. Such a pressure, acting on diaphragm 70, produces a force of 2.5 pounds which is sufficient to close the contacts 74 and 94. While the foregoing assumes sea level conditions, release at a higher altitude will require a greater change in altitude before the switch will close. For example at a release altitude of 60,000 feet, the switch contacts 74 and 94 will not close until the bomb has fallen to 53,000 feet. However, at a release altitude of 15,000 feet, for example, the bomb must fall to 13,500 feet before the closure of switch contacts 74 and 94. Such a feature is compatible with close support missions where minimum closure times are required.

It is seen that I have provided, by virtue of the foregoing, a highly reliable, dual channel redundant bomb fuze system by means of which present-day military standards may be complied with without any sacrifice in reliability. A static ram air conduit 130, seen in FIG. 2, overcomes a source of erratic performance uncovered during the testing of the present invention when a single tube was utilized for the air supply. The present invention, while providing increased safety and reliability, is compatible with the all-up weapon concept, as well as with the modular weapon concept. That is to say, the existence of an environmental safing/arming function, as well as a power source, would enable the addition of a proximity function with only minor modifications. The plug-in module would consist of the proximity sensor only, inasmuch as the arming/explosive train functions are provided by the preferred embodiment point detonation fuze described above. Other modular configurations are also possible with the present invention, such as the electrical activation of very long delay systems, perhaps positioned in the tail section of the aircraft, after impact. Optical sensors could also be provided.

I therefore wish it to be understood that I do not desire to be limited to the exact details in construction shown and described, for obvious modifications may be made by persons skilled in the art.

I claim as my invention:

1. A dual channel redundant fuze for aircraft-carried bombs, which comprises:

a fuze housing containing a pair of substantially identical actuation channels, each of which comprises:

ram air actuated means for generating electrical energy;

governor means coupled to said ram air actuated means for regulating gear box means;

rotor means coupled to said gear box means for rotating a detonator from a safe position to an armed position; and booster means explosively responsive to the actuation of said detonator means only when the latter is in said armed position;

said fuze further comprising:

ram air receiving means positioned remotely from said housing; and barometric sensing switch means positioned within said housing and responsive to ram air and ambient pressure for preventing electrical energy from being coupled out from said ram air actuated means until said fuzed bomb has fallen a predeterminable distance from said aircraft.

2. The dual channel redundant fuze as set forth in claim 1, further comprising dual conduit means for placing said ram air receiving means in fluid communication with said fuze housing.

3. The dual channel redundant fuze as set forth in claim 2, wherein said dual conduit means comprises a first tube for channeling ram air to said housing, and a second tube, placed within said first tube, for channeling exhaust air from said housing.

4. The dual channel redundant fuze as set forth in claim 1, wherein said ram air actuated means comprises a turbine wheel rotatable about a shaft, an electrical alternator connected to said shaft, and output leads for coupling out the electrical energy generated thereby.

5. The dual channel redundant fuze as set forth in claim 4, wherein each of said actuation channels further includes electronic circuit timing means connected to said output leads via said barometric sensing switch means whereby said electronic circuit timing means is not activated until said predeterminable distance has been reached.

6. The dual channel redundant fuze as set forth in claim 5, wherein said electronic circuit timing means of each actuation channel are cross-coupled to one another so as to provide high reliability for said fuze.

7. The dual channel redundant fuze as set forth in claim 4, wherein said barometric sensing switch means further includes safety means for preventing rotation of said turbine wheel until sufficient ram air is received in said housing.

8. The dual channel redundant fuze as set forth in claim 7, wherein said safety means includes a turbine lock shaft and a turbine lock arm rigidly connected to said shaft, and normally interlocked with said turbine wheel, said shaft being movably responsive to ram air so as to cause said lock arm to become disengaged from its respective turbine wheel to thereby allow free rotation thereof.

9. The dual channel redundant fuze as set forth in claim 8, further comprising conduit means for communicating ram air from said receiving means to said housing, a receiving channel positioned within said housing to direct said ram air from said conduit means to said turbine wheels and to said barometric sensing switch means, said turbine lock arm being positioned within said receiving channel, and exhaust ports in fluid communication with said turbine wheels.

10. The dual channel redundant fuze as set forth in claim 9, wherein said barometric sensing switch means comprises first and second chambers in normal fluid communication via a common vent, a third chamber in communication with said receiving channel, and a fourth chamber in fluid communication with said exhaust ports.

11. The dual channel redundant fuze as set forth in claim 10, wherein said barometric sensing switch means includes first and second pressure responsive means for respectively closing said vent in response to the receipt of ram air in said third chamber and for closing a pair of electrical contacts in response to a predetermined rise in pressure in said fourth chamber.

12. The dual channel redundant fuze as set forth in claim 11, wherein said first pressure responsive means comprises a flexible diaphragm which separates said second chamber from said third chamber.

13. The dual channel redundant fuze as set forth in claim 12, wherein said second pressure responsive means separates said first chamber from said fourth chamber, said first and second chambers being separated by a rigid wall having said vent centrally positioned therein.

14. The dual channel redundant fuze as set forth in claim 13, wherein said barometric sensing switch means further comprises valve means connected to said first diaphragm and movable therewith and adapted to fit within said vent.

15. The dual channel redundant fuze as set forth in claim 14, further comprising spring means for biasing said first diaphragm in a central position wherein said valve means is not fitted within said vent.

16. The dual channel redundant fuze as set forth in claim 15, wherein said second chamber is in fluid communication with said exhaust ports.

17. The dual channel redundant fuze as set forth in claim 16, wherein said valve means is formed on one end of said turbine lock shaft.

18. The dual channel redundant fuze as set forth in claim 17, wherein one of said electrical contacts is connected to said output leads from said attenuator, and wherein the other of said contacts is connected to said electronic timing circuit means.

* * * * *